US011105501B2

(12) United States Patent
Minami et al.

(10) Patent No.: US 11,105,501 B2
(45) Date of Patent: Aug. 31, 2021

(54) HIGH-CHROMIUM HEAT-RESISTANT STEEL

(71) Applicant: TENARIS CONNECTIONS LIMITED, Kingstown (VC)

(72) Inventors: Yusuke Minami, Kawasaki (JP); Tatsuo Ono, Yokohamashi (JP); Giuseppe Cumino, Dalmine (IT); Paola Mariani, Capriate San Gervasio (IT)

(73) Assignee: Tenaris Connections B.V., Amsterdam (NL)

( * ) Notice: Subject to any disclaimer, the term of this patent is extended or adjusted under 35 U.S.C. 154(b) by 0 days.

(21) Appl. No.: 14/411,042

(22) PCT Filed: Jun. 24, 2014

(86) PCT No.: PCT/IB2014/062561

§ 371 (c)(1),
(2) Date: Dec. 23, 2014

(87) PCT Pub. No.: WO2014/207656

PCT Pub. Date: Dec. 31, 2014

(65) Prior Publication Data

US 2016/0102856 A1 Apr. 14, 2016

(30) Foreign Application Priority Data

Jun. 25, 2013 (EP) ..... 13173530

(51) Int. Cl.

| | |
|---|---|
| ***C22C 38/48*** | (2006.01) |
| ***C22C 38/46*** | (2006.01) |
| ***C22C 38/00*** | (2006.01) |
| ***C22C 38/06*** | (2006.01) |
| ***C22C 38/04*** | (2006.01) |
| ***C22C 38/02*** | (2006.01) |
| ***C22C 38/54*** | (2006.01) |
| ***C22C 38/44*** | (2006.01) |
| ***F22B 37/04*** | (2006.01) |
| ***C22C 38/26*** | (2006.01) |
| ***C22C 38/22*** | (2006.01) |
| ***C22C 38/24*** | (2006.01) |
| ***C22C 38/32*** | (2006.01) |
| ***F01K 5/02*** | (2006.01) |

(52) U.S. Cl.

CPC ..... *F22B 37/04* (2013.01); *C22C 38/001* (2013.01); *C22C 38/002* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/32* (2013.01); *C22C 38/44* (2013.01); *C22C 38/46* (2013.01); *C22C 38/48* (2013.01); *C22C 38/54* (2013.01); *F01K 5/02* (2013.01)

(58) Field of Classification Search

CPC ..... F22B 37/04; C22C 38/001; C22C 38/002; C22C 38/02; C22C 38/04; C22C 38/06; C22C 38/22; C22C 38/24; C22C 38/26; C22C 38/32; C22C 38/44; C22C 38/46; C22C 38/48; C22C 38/54; F01K 5/02

See application file for complete search history.

(56) References Cited

U.S. PATENT DOCUMENTS

| | | | |
|---|---|---|---|
| 3,316,395 | A | 4/1967 | Lavin |
| 3,316,396 | A | 4/1967 | Trott et al. |
| 3,325,174 | A | 6/1967 | Weaver |
| 3,362,731 | A | 1/1968 | Gasche et al. |
| 3,366,392 | A | 1/1968 | Kennel |
| 3,413,166 | A | 11/1968 | Zackay et al. |
| 3,489,437 | A | 1/1970 | Duret |
| 3,512,789 | A | 5/1970 | Tanner |
| 3,552,781 | A | 1/1971 | Helland |
| 3,572,777 | A | 3/1971 | Blose et al. |
| 3,575,430 | A | 4/1971 | Alpine |
| 3,592,491 | A | 7/1971 | Glover |
| 3,599,931 | A | 8/1971 | Hanson |
| 3,655,465 | A | 4/1972 | Snape et al. |
| 3,733,093 | A | 5/1973 | Seiler |
| 3,810,793 | A | 5/1974 | Heller |
| 3,854,760 | A | 12/1974 | Duret |
| 3,889,989 | A | 6/1975 | Legris et al. |
| 3,891,224 | A | 6/1975 | Ditcher |
| 3,893,919 | A | 7/1975 | Flegel et al. |
| 3,915,697 | A | 10/1975 | Giuliani et al. |
| 3,918,726 | A | 11/1975 | Kramer |
| 3,986,731 | A | 10/1976 | DeHoff |
| 4,014,568 | A | 3/1977 | Carter et al. |
| 4,147,368 | A | 4/1979 | Baker et al. |
| 4,163,290 | A | 7/1979 | Sutherlin et al. |

(Continued)

FOREIGN PATENT DOCUMENTS

| | | | |
|---|---|---|---|
| AR | 0050159 | A1 | 10/2006 |
| AT | 388791 | B | 8/1989 |
| CA | 2319926 | | 7/2008 |
| CN | 1401809 | | 3/2003 |
| CN | 1487112 | | 4/2004 |
| CN | 1292429 | | 12/2006 |
| CN | 101480671 | | 7/2009 |
| CN | 101542002 | | 9/2009 |
| CN | 101613829 | A | 12/2009 |
| CN | 101413089 | | 11/2010 |

(Continued)

OTHER PUBLICATIONS

Machine translation of JP2009-293063A. (Year: 2009).*
Search Report and Written Opinion for International App No. PCT/IB2014/062561 dated Sep. 25, 2014, 11 pages.

(Continued)

*Primary Examiner* — Xiaowei Su
(74) *Attorney, Agent, or Firm* — Knobbe, Martens, Olson & Bear, LLP

(57) ABSTRACT

The present invention provides a high-chromium heat-resistant steel. The steel contains in mass %, C: 0.08% to 0.13%; Si: 0.15% to 0.45%; Mn: 0.1% to 1.0%; Ni: 0.01% to 0.5%; Cr: 10.0% to 11.5%; Mo: 0.3% to 0.6%; V: 0.10% to 0.25%; Nb: 0.01% to 0.06%; N: 0.015% to 0.07%; B: ≤0.005%, and Al: ≤0.04%. The balance consists of Fe and inevitable impurity elements. The steel shows a martensitic microstructure.

26 Claims, No Drawings

(56) References Cited

U.S. PATENT DOCUMENTS 4,219,204 A 8/1980 Pippert
4,231,555 A 11/1980 Saito
4,299,412 A 10/1981 Parmann
4,305,059 A 12/1981 Benton
4,310,163 A 1/1982 Pippert
4,336,081 A 6/1982 Hijikata et al.
4,345,739 A 8/1982 Wheatley
4,354,882 A 10/1982 Greer
4,366,971 A 1/1983 Lula
4,368,894 A 1/1983 Parmann
4,373,750 A 2/1983 Mantelle et al.
4,376,528 A 3/1983 Ohshimatani et al.
4,379,482 A 4/1983 Suzuki et al.
4,384,737 A 5/1983 Reusser
4,406,561 A 9/1983 Ewing
4,407,681 A 10/1983 Ina et al.
4,426,095 A 1/1984 Buttner
4,445,265 A 5/1984 Olson et al.
4,473,471 A 9/1984 Robichaud et al.
4,475,839 A 10/1984 Strandberg
4,491,725 A 1/1985 Pritchard
4,506,432 A 3/1985 Smith
4,526,628 A 7/1985 Ohno et al.
4,527,815 A 7/1985 Smith
4,564,392 A 1/1986 Ohhashi et al.
4,570,982 A 2/1986 Blose et al.
4,591,195 A 5/1986 Chelette et al.
4,592,558 A 6/1986 Hopkins
4,601,491 A 7/1986 Bell, Jr. et al.
4,602,807 A 7/1986 Bowers
4,623,173 A 11/1986 Handa et al.
4,629,218 A 12/1986 Dubois
4,662,659 A 5/1987 Blose et al.
4,674,756 A 6/1987 Fallon et al.
4,688,832 A 8/1987 Ortloff et al.
4,706,997 A 11/1987 Carstensen
4,710,245 A 12/1987 Roether
4,721,536 A 1/1988 Koch et al.
4,758,025 A 7/1988 Frick
4,762,344 A 8/1988 Perkins et al.
4,812,182 A 3/1989 Fang et al.
4,814,141 A 3/1989 Imai et al.
4,844,517 A 7/1989 Beiley et al.
4,856,828 A 8/1989 Kessler et al.
4,955,645 A 9/1990 Weems
4,958,862 A 9/1990 Cappelli et al.
4,988,127 A 1/1991 Cartensen
5,007,665 A 4/1991 Bovisio et al.
5,067,874 A 11/1991 Foote
5,137,310 A 8/1992 Noel et al.
5,143,381 A 9/1992 Temple
5,154,534 A 10/1992 Guerin et al.
5,180,008 A 1/1993 Aldridge et al.
5,191,911 A 3/1993 Dubois
5,242,199 A 9/1993 Hann et al.
5,328,158 A 7/1994 Lewis et al.
5,348,350 A 9/1994 Blose et al.
5,352,406 A 10/1994 Barteri et al.
5,360,239 A 11/1994 Klementich
5,449,420 A 9/1995 Okada et al.
5,454,883 A 10/1995 Yoshie et al.
5,456,405 A 10/1995 Stagg
5,505,502 A 4/1996 Smith et al.
5,515,707 A 5/1996 Smith
5,538,566 A 7/1996 Gallagher
5,592,988 A 1/1997 Meroni et al.
5,598,735 A 2/1997 Saito et al.
5,653,452 A 8/1997 Jarvenkyla
5,712,706 A 1/1998 Castore et al.
5,794,985 A 8/1998 Mallis
5,810,401 A 9/1998 Mosing et al.
5,860,680 A 1/1999 Drijver et al.
5,870,976 A * 2/1999 Cooke ..... F22B 1/18
122/235.15
5,879,030 A 3/1999 Clayson et al.
5,879,474 A 3/1999 Bhadeshia et al.
5,944,921 A 8/1999 Cumino et al.
5,993,570 A 11/1999 Gray
6,006,789 A 12/1999 Toyooka et al.
6,030,470 A 2/2000 Hensger et al.
6,044,539 A 4/2000 Guzowksi
6,045,165 A 4/2000 Sugino et al.
6,056,324 A 5/2000 Reimert et al.
6,070,912 A 6/2000 Latham
6,173,968 B1 1/2001 Nelson et al.
6,188,037 B1 2/2001 Hamada et al.
6,196,530 B1 3/2001 Muhr et al.
6,217,676 B1 4/2001 Takabe et al.
6,248,187 B1 6/2001 Asahi et al.
6,257,056 B1 7/2001 Shibayama et al.
6,267,828 B1 7/2001 Kushida et al.
6,311,965 B1 11/2001 Muhr et al.
6,331,216 B1 12/2001 Toyooka et al.
6,347,814 B1 2/2002 Cerruti
6,349,979 B1 2/2002 Noel et al.
6,358,336 B1 3/2002 Miyata
6,384,388 B1 5/2002 Anderson et al.
6,412,831 B1 7/2002 Noel et al.
6,447,025 B1 9/2002 Smith
6,478,344 B2 11/2002 Pallini, Jr. et al.
6,481,760 B1 11/2002 Noel et al.
6,494,499 B1 12/2002 Galle, Sr. et al.
6,514,359 B2 2/2003 Kawano
6,527,056 B2 3/2003 Newman
6,540,848 B2 4/2003 Miyata et al.
6,550,822 B2 4/2003 Mannella et al.
6,557,906 B1 5/2003 Carcagno
6,558,484 B1 5/2003 Onoe et al.
6,581,940 B2 6/2003 Dittel
6,632,296 B2 10/2003 Yoshinaga et al.
6,648,991 B2 11/2003 Turconi et al.
6,669,285 B1 12/2003 Park et al.
6,669,789 B1 12/2003 Edelman et al.
6,682,610 B1 1/2004 Inoue
6,683,834 B2 1/2004 Ohara et al.
6,709,534 B2 3/2004 Kusinski et al.
6,752,436 B1 6/2004 Verdillon
6,755,447 B2 6/2004 Galle, Jr. et al.
6,764,108 B2 7/2004 Ernst et al.
6,767,417 B2 7/2004 Fujita et al.
6,814,358 B2 11/2004 Keck
6,851,727 B2 2/2005 Carcagno et al.
6,857,668 B2 2/2005 Otten et al.
6,883,804 B2 4/2005 Cobb
6,905,150 B2 6/2005 Carcagno et al.
6,921,110 B2 7/2005 Morotti et al.
6,958,099 B2 10/2005 Nakamura et al.
6,971,681 B2 12/2005 Dell'Erba et al.
6,991,267 B2 1/2006 Ernst et al.
7,014,223 B2 3/2006 Della Pina et al.
7,066,499 B2 6/2006 Della Pina et al.
7,074,283 B2 7/2006 Omura
7,083,686 B2 8/2006 Itou
7,108,063 B2 9/2006 Carstensen
7,118,637 B2 10/2006 Kusinski et al.
7,182,140 B2 2/2007 Wood
7,214,278 B2 5/2007 Kusinski et al.
7,255,374 B2 8/2007 Carcagno et al.
7,264,684 B2 9/2007 Numata et al.
7,284,770 B2 10/2007 Dell'erba et al.
7,310,867 B2 12/2007 Corbett, Jr.
7,431,347 B2 10/2008 Ernst et al.
7,464,449 B2 12/2008 Santi et al.
7,475,476 B2 1/2009 Roussie
7,478,842 B2 1/2009 Reynolds, Jr. et al.
7,506,900 B2 3/2009 Carcagno et al.
7,621,034 B2 11/2009 Roussie
7,635,406 B2 12/2009 Numata et al.
7,735,879 B2 6/2010 Toscano et al.
7,744,708 B2 6/2010 López et al.
7,753,416 B2 7/2010 Mazzaferro et al.
7,862,667 B2 1/2011 Turconi et al.
8,002,910 B2 8/2011 Tivelli et al.
8,007,601 B2 8/2011 López et al.

(56) References Cited

U.S. PATENT DOCUMENTS

| | | | |
|---|---|---|---|
| 8,007,603 | B2 | 8/2011 | Garcia et al. |
| 8,016,362 | B2 | 9/2011 | Itoga |
| 8,215,680 | B2 | 7/2012 | Santi |
| 8,221,562 | B2 | 7/2012 | Valdez et al. |
| 8,262,094 | B2 | 9/2012 | Beele |
| 8,262,140 | B2 | 9/2012 | Santi et al. |
| 8,317,946 | B2 | 11/2012 | Arai et al. |
| 8,322,754 | B2 | 12/2012 | Carcagno |
| 8,328,958 | B2 | 12/2012 | Turconi et al. |
| 8,328,960 | B2 | 12/2012 | Gomez et al. |
| 8,333,409 | B2 | 12/2012 | Santi et al. |
| 8,414,715 | B2 | 4/2013 | Altschuler et al. |
| 8,544,304 | B2 | 10/2013 | Santi |
| 8,636,856 | B2 | 1/2014 | Altschuler et al. |
| 8,821,653 | B2 | 9/2014 | Anelli et al. |
| 8,840,152 | B2 | 9/2014 | Carcagno et al. |
| 8,926,771 | B2 | 1/2015 | Agazzi |
| 9,004,544 | B2 | 4/2015 | Carcagno et al. |
| 9,163,296 | B2 | 10/2015 | Valdez et al. |
| 9,187,811 | B2 | 11/2015 | Gomez et al. |
| 9,188,252 | B2 | 11/2015 | Altschuler et al. |
| 9,222,156 | B2 | 12/2015 | Altschuler et al. |
| 9,234,612 | B2 | 1/2016 | Santi et al. |
| 9,340,847 | B2 | 5/2016 | Altschuler et al. |
| 9,383,045 | B2 | 7/2016 | Santi et al. |
| 9,598,746 | B2 | 3/2017 | Anelli et al. |
| 9,644,248 | B2 | 5/2017 | Anelli et al. |
| 9,708,681 | B2 | 7/2017 | Eguchi et al. |
| 9,970,242 | B2 | 5/2018 | Narikawa et al. |
| 2001/0035235 | A1 | 11/2001 | Kawano |
| 2002/0011284 | A1 | 1/2002 | Von Hagen et al. |
| 2002/0153671 | A1 | 10/2002 | Raymond et al. |
| 2002/0158469 | A1 | 10/2002 | Mannella et al. |
| 2003/0019549 | A1 | 1/2003 | Turconi et al. |
| 2003/0111146 | A1 | 6/2003 | Kusinski et al. |
| 2003/0116238 | A1 | 6/2003 | Fujita |
| 2003/0155052 | A1 | 8/2003 | Kondo et al. |
| 2003/0165098 | A1 | 9/2003 | Ohara et al. |
| 2003/0168859 | A1 | 9/2003 | Watts |
| 2004/0118490 | A1 | 6/2004 | Klueh et al. |
| 2004/0118569 | A1 | 6/2004 | Brill et al. |
| 2004/0131876 | A1 | 7/2004 | Ohgami et al. |
| 2004/0139780 | A1 | 7/2004 | Cai et al. |
| 2004/0187971 | A1 | 9/2004 | Omura |
| 2004/0195835 | A1 | 10/2004 | Noel et al. |
| 2004/0262919 | A1 | 12/2004 | Dutilleul et al. |
| 2005/0012278 | A1 | 1/2005 | Delange |
| 2005/0076975 | A1 | 4/2005 | Lopez |
| 2005/0087269 | A1 | 4/2005 | Merwin |
| 2005/0093250 | A1 | 5/2005 | Santi et al. |
| 2005/0166986 | A1 | 8/2005 | Dell'erba et al. |
| 2006/0006600 | A1 | 1/2006 | Roussie |
| 2006/0124211 | A1 | 6/2006 | Takano et al. |
| 2006/0137781 | A1 | 6/2006 | Kusinski et al. |
| 2006/0157539 | A1 | 7/2006 | Dubois |
| 2006/0169368 | A1 | 8/2006 | Lopez et al. |
| 2006/0231168 | A1 | 10/2006 | Nakamura et al. |
| 2006/0243355 | A1 | 11/2006 | Haiderer et al. |
| 2006/0273586 | A1 | 12/2006 | Reynolds, Jr. et al. |
| 2007/0039147 | A1 | 2/2007 | Roussie |
| 2007/0089813 | A1 | 4/2007 | Tivelli |
| 2007/0137736 | A1 | 6/2007 | Omura et al. |
| 2007/0216126 | A1 | 9/2007 | Lopez et al. |
| 2007/0246219 | A1 | 10/2007 | Manella et al. |
| 2008/0047635 | A1 | 2/2008 | Kondo et al. |
| 2008/0115863 | A1 | 5/2008 | McCrink et al. |
| 2008/0129044 | A1 | 6/2008 | Carcagno et al. |
| 2008/0219878 | A1 | 9/2008 | Konda et al. |
| 2008/0226396 | A1 | 9/2008 | Garcia et al. |
| 2008/0226491 | A1 | 9/2008 | Satou et al. |
| 2008/0257459 | A1 | 10/2008 | Arai et al. |
| 2008/0264129 | A1 | 10/2008 | Cheppe et al. |
| 2008/0303274 | A1 | 12/2008 | Mazzaferro et al. |
| 2008/0314481 | A1 | 12/2008 | Garcia et al. |
| 2009/0010794 | A1 | 1/2009 | Lopez et al. |
| 2009/0033087 | A1 | 2/2009 | Carcagno et al. |
| 2009/0047166 | A1 | 2/2009 | Tomomatsu et al. |
| 2009/0101242 | A1 | 4/2009 | Lopez et al. |
| 2009/0114318 | A1 | 5/2009 | Arai et al. |
| 2009/0226491 | A1 | 9/2009 | Satou et al. |
| 2010/0068549 | A1 | 3/2010 | Agazzi |
| 2010/0136363 | A1 | 6/2010 | Valdez et al. |
| 2010/0187808 | A1 | 7/2010 | Santi |
| 2010/0193085 | A1 | 8/2010 | Garcia |
| 2010/0206553 | A1 | 8/2010 | Bailey et al. |
| 2010/0294401 | A1 | 11/2010 | Gomez |
| 2010/0319814 | A1 | 12/2010 | Perez |
| 2010/0327550 | A1 | 12/2010 | Lopez |
| 2011/0042946 | A1 | 2/2011 | Santi |
| 2011/0077089 | A1 | 3/2011 | Hirai et al. |
| 2011/0097235 | A1 | 4/2011 | Turconi et al. |
| 2011/0133449 | A1 | 6/2011 | Mazzaferro |
| 2011/0233925 | A1 | 9/2011 | Pina |
| 2011/0247733 | A1 | 10/2011 | Arai et al. |
| 2011/0259482 | A1 | 10/2011 | Peters et al. |
| 2011/0284137 | A1 | 11/2011 | Kami et al. |
| 2012/0018056 | A1 | 1/2012 | Nakagawa et al. |
| 2012/0199255 | A1 | 8/2012 | Anelli |
| 2012/0204994 | A1 | 8/2012 | Anelli |
| 2012/0211132 | A1 | 8/2012 | Altschuler |
| 2012/0267014 | A1 | 10/2012 | Hitoshio et al. |
| 2013/0000790 | A1 | 1/2013 | Arai et al. |
| 2013/0004787 | A1 | 1/2013 | Ishiyama et al. |
| 2013/0264123 | A1 | 10/2013 | Altschuler |
| 2014/0021244 | A1 | 1/2014 | DuBois |
| 2014/0027497 | A1 | 1/2014 | Rowland et al. |
| 2014/0057121 | A1 | 2/2014 | Altschuler |
| 2014/0137992 | A1 | 5/2014 | Ishiguro et al. |
| 2014/0251512 | A1 | 9/2014 | Gomez |
| 2014/0272448 | A1 | 9/2014 | Valdez et al. |
| 2014/0299235 | A1 | 10/2014 | Anelli |
| 2014/0299236 | A1 | 10/2014 | Anelli |
| 2015/0368986 | A1 | 12/2015 | Narikawa |
| 2016/0024625 | A1 | 1/2016 | Valdez |
| 2016/0102856 | A1 | 4/2016 | Minami |
| 2016/0281188 | A1 | 9/2016 | Valdez et al. |
| 2016/0305192 | A1 | 10/2016 | Buhler |

FOREIGN PATENT DOCUMENTS

| | | | |
|---|---|---|---|
| DE | 3310226 | A1 | 10/1984 |
| DE | 4446806 | | 5/1996 |
| EA | 010037 | | 6/2008 |
| EA | 012256 | | 8/2009 |
| EP | 0 032 265 | | 7/1981 |
| EP | 0 092 815 | | 11/1983 |
| EP | 0 104 720 | | 4/1984 |
| EP | 0 159 385 | | 10/1985 |
| EP | 0 309 179 | | 3/1989 |
| EP | 0 340 385 | | 11/1989 |
| EP | 0 329 990 | | 11/1992 |
| EP | 0 658 632 | | 6/1995 |
| EP | 0 753 595 | | 1/1997 |
| EP | 0 788 850 | | 8/1997 |
| EP | 0 828 007 | A | 3/1998 |
| EP | 0 989 196 | | 3/2000 |
| EP | 1 008 660 | | 6/2000 |
| EP | 01027944 | B1 | 8/2000 |
| EP | 1 065 423 | | 1/2001 |
| EP | 828 007 | | 11/2001 |
| EP | 1 277 848 | | 1/2003 |
| EP | 1 288 316 | | 3/2003 |
| EP | 1 296 088 | | 3/2003 |
| EP | 1 362977 | | 11/2003 |
| EP | 1 413 639 | | 4/2004 |
| EP | 1 182 268 | | 9/2004 |
| EP | 0 788 850 | | 8/2005 |
| EP | 1 705 415 | | 9/2006 |
| EP | 1 717 324 | | 11/2006 |
| EP | 1 726 861 | | 11/2006 |
| EP | 1 876 254 | | 1/2008 |
| EP | 1 914 324 | | 4/2008 |
| EP | 1 554 518 | | 1/2009 |
| EP | 2 028 284 | | 2/2009 |

(56) References Cited

FOREIGN PATENT DOCUMENTS

| | | | |
|---|---|---|---|
| EP | 2 133 442 | | 12/2009 |
| EP | 2 216 576 | | 8/2010 |
| EP | 2 239 343 | | 10/2010 |
| EP | 2 778 239 | | 9/2014 |
| FR | 1 149 513 | A | 12/1957 |
| FR | 2 704 042 | A | 10/1994 |
| FR | 2 848 282 | A1 | 6/2004 |
| FR | 2855587 | | 12/2004 |
| GB | 498 472 | | 1/1939 |
| GB | 1 398 214 | | 6/1973 |
| GB | 1 428 433 | | 3/1976 |
| GB | 2 104 919 | A | 3/1983 |
| GB | 2 234 308 | A | 1/1991 |
| GB | 2 276 647 | | 10/1994 |
| GB | 2 388 169 | A | 11/2003 |
| JP | 58-187684 | | 12/1983 |
| JP | 60-086209 | | 5/1985 |
| JP | S60 116796 | A | 6/1985 |
| JP | 60-215719 | | 10/1985 |
| JP | 36025719 | | 10/1985 |
| JP | S61-103061 | | 5/1986 |
| JP | 61270355 | | 11/1986 |
| JP | 63004046 | A2 | 1/1988 |
| JP | 63004047 | A2 | 1/1988 |
| JP | 63230847 | A2 | 9/1988 |
| JP | 63230851 | A2 | 9/1988 |
| JP | 01-242761 | A | 9/1989 |
| JP | 01 259124 | A2 | 10/1989 |
| JP | 01 259125 | A2 | 10/1989 |
| JP | 01 283322 | A2 | 11/1989 |
| JP | H0288716 | | 3/1990 |
| JP | 05-098350 | | 12/1990 |
| JP | 403006329 | A | 1/1991 |
| JP | 04 021718 | A2 | 1/1992 |
| JP | 04 107214 | | 4/1992 |
| JP | 04 231414 | A2 | 8/1992 |
| JP | 05 287381 | A2 | 11/1993 |
| JP | H06-042645 | | 2/1994 |
| JP | 06-093339 | | 4/1994 |
| JP | 06 172859 | A2 | 6/1994 |
| JP | 06-220536 | | 8/1994 |
| JP | 07-003330 | | 1/1995 |
| JP | 07 041856 | A2 | 2/1995 |
| JP | 07-139666 | | 5/1995 |
| JP | 07 197125 | A2 | 8/1995 |
| JP | 08 311551 | | 11/1996 |
| JP | 09 067624 | A2 | 3/1997 |
| JP | 09-235617 | | 9/1997 |
| JP | 2704042 | | 10/1997 |
| JP | 10 140250 | | 5/1998 |
| JP | 10176239 | | 6/1998 |
| JP | 10 280037 | A | 10/1998 |
| JP | 11 050148 | A | 2/1999 |
| JP | 11140580 | | 5/1999 |
| JP | 11229079 | | 8/1999 |
| JP | 2000-063940 | | 2/2000 |
| JP | 2000-178645 | | 6/2000 |
| JP | 2000-248337 | A | 9/2000 |
| JP | 2000-313919 | A2 | 11/2000 |
| JP | 2000248337 | | 12/2000 |
| JP | 2001-131698 | | 5/2001 |
| JP | 2001-164338 | | 6/2001 |
| JP | 2001-172739 | A2 | 6/2001 |
| JP | 2001-220653 | A | 8/2001 |
| JP | 2001-271134 | | 10/2001 |
| JP | 2002-096105 | A2 | 4/2002 |
| JP | 2002-130554 | | 5/2002 |
| JP | 2003-041341 | A2 | 2/2003 |
| JP | 2004-011009 | | 1/2004 |
| JP | 2007-031769 | | 7/2005 |
| JP | 60 174822 | | 9/2005 |
| JP | 2005-350754 | A2 | 12/2005 |
| JP | 2009293063 | | 12/2009 |
| KR | 0245031 | | 3/2000 |
| KZ | 1418 | B | 12/1994 |
| KZ | 2506 | B | 9/1995 |
| KZ | 2673 | B | 12/1995 |
| WO | WO 1984/002947 | | 8/1984 |
| WO | WO 1994/29627 | | 12/1994 |
| WO | WO 1996/22396 | | 7/1996 |
| WO | WO 2000/06931 | | 2/2000 |
| WO | WO 2000/70107 | | 11/2000 |
| WO | WO 2001/075345 | | 10/2001 |
| WO | WO 2001/88210 | | 11/2001 |
| WO | WO 2002/29290 | | 4/2002 |
| WO | WO 2002/035128 | | 5/2002 |
| WO | WO 2002/068854 | | 9/2002 |
| WO | WO 2002/086369 | | 10/2002 |
| WO | WO 2002/093045 | | 11/2002 |
| WO | WO 2003/033856 | | 4/2003 |
| WO | WO 2003/048623 | | 6/2003 |
| WO | WO 2003/087646 | | 10/2003 |
| WO | WO 2004/023020 | | 3/2004 |
| WO | WO 2004/031420 | | 4/2004 |
| WO | WO 2004/033951 | | 4/2004 |
| WO | WO 2004/053376 | | 6/2004 |
| WO | WO 2004/097059 | | 11/2004 |
| WO | WO 2004/109173 | | 12/2004 |
| WO | WO 2006/003775 | | 6/2005 |
| WO | WO 2006/009142 | | 1/2006 |
| WO | WO 2006/087361 | | 4/2006 |
| WO | WO 2006/078768 | | 7/2006 |
| WO | WO 2007/002576 | | 1/2007 |
| WO | WO 2007/017082 | | 2/2007 |
| WO | WO 2007/017161 | | 2/2007 |
| WO | WO 2007/023806 | | 3/2007 |
| WO | WO 2007/028443 | | 3/2007 |
| WO | WO 2007/034063 | | 3/2007 |
| WO | WO 2007/063079 | | 6/2007 |
| WO | WO 2008/003000 | | 1/2008 |
| WO | WO 2008/007737 | | 1/2008 |
| WO | WO 2008/090411 | | 7/2008 |
| WO | WO 2008/110494 | | 9/2008 |
| WO | WO 2008/127084 | | 10/2008 |
| WO | WO 2009/000851 | | 12/2008 |
| WO | WO 2009/000766 | | 1/2009 |
| WO | WO 2009/010507 | | 1/2009 |
| WO | WO 2009/027308 | | 3/2009 |
| WO | WO 2009/027309 | | 3/2009 |
| WO | WO 2009/044297 | | 4/2009 |
| WO | WO 2009/065432 | | 5/2009 |
| WO | WO 2009/106623 | | 9/2009 |
| WO | WO 2010/061882 | | 6/2010 |
| WO | WO 2010/122431 | | 10/2010 |
| WO | WO 2011/152240 | | 12/2011 |
| WO | WO 2013/007729 | | 1/2013 |
| WO | WO 2013/094179 | | 6/2013 |

OTHER PUBLICATIONS

"Seamless Steel Tubes for Pressure Purposes—Technical Delivery Conditions—Part 1: Non-alloy Steel Tubes with Specified Room Temperature Properties" British Standard BS EN 10216-1:2002 E:1-26, published May 2002.

"Seamless Steel Tubes for Pressure Purposes—Technical Delivery Conditions—Part 2: Non-alloy and Alloy Steel Tubes with Specified Elevated Temperature Properties" British Standard BS EN 10216-2:2002+A2:2007:E:1-45, published Aug. 2007.

"Seamless Steel Tubes for Pressure Purposes—Technical Delivery Conditions—Part 3: Alloy Fine Grain Steel Tubes" British Standard BS EN 10216-3:2002 +A1:2004 E:1-34, published Mar. 2004.

Aggarwal, R. K., et al.: "Qualification of Solutions for Improving Fatigue Life at SCR Touch Down Zone", Deep Offshore Technology Conference, Nov. 8-10, 2005, Vitoria, Espirito Santo, Brazil, in 12 pages.

Anelli, E., D. Colleluori, M. Pontremoli, G. Cumino, A. Izquierdo, H. Quintanilla, "Metallurgical design of advanced heavy wall seamless pipes for deep-water applications", 4th International Conference on Pipeline Technology, May 9 to 13, 2004, Ostend, Belgium.

Asahi, et al., Development of Ultra-high-strength Linepipe, X120, Nippon Steel Technical Report, Jul. 2004, Issue 90, pp. 82-87.

(56) References Cited

OTHER PUBLICATIONS

ASM Handbook, Mechanical Tubing and Cold Finishing, Metals Handbook Desk Edition, (2000), 5 pages.
Bai, M., D. Liu, Y. Lou, X. Mao, L. Li, X. Huo, "Effects of Ti addition on low carbon hot strips produced by CSP process", Journal of University of Science and Technology Beijing, 2006, vol. 13, No. 3, p. 230.
Beretta, Stefano et al., "Fatigue Assessment of Tubular Automotive Components in Presence of Inhomogeneities", Proceedings of IMECE2004, ASME International Mechanical Engineering Congress, Nov. 13-19, 2004, pp. 1-8.
Berner, Robert A., "Tetragonal Iron Sulfide", Science, Aug. 31, 1962, vol. 137, Issue 3531, pp. 669.
Berstein et al.,"The Role of Traps in the Microstructural Control of Hydrogen Embrittlement of Steels" Hydrogen Degradation of Ferrous Alloys, Ed. T. Oriani, J. Hirth, and M. Smialowski, Noyes Publications, 1988, pp. 641-685.
Boulegue, Jacques, "Equilibria in a sulfide rich water from Enghien-les-Bains, France", Geochimica et Cosmochimica Acta, Pergamom Press, 1977, vol. 41, pp. 1751-1758, Great Britain.
Bruzzoni et al.: "Study of Hydrogen Permeation Through Passive Films on Iron Using Electrochemical Impedance Spectroscopy," 2003.
Cancio et al., "Characterization of microalloy precipitates in the austenitic range of high strength low alloy steels", Steel Research, 2002, vol. 73, pp. 340-346.
Carboni, A., A. Pigani, G. Megahed, S. Paul, "Casting and rolling of API X 70 grades for artic application in a thin slab rolling plant", Stahl u Eisen, 2008, No. 1, p. 131-134.
Chang, L.C., "Microstructures and reaction kinetics of bainite transformation in Si-rich steels," XP0024874, Materials Science and Engineering, vol. 368, No. 1-2, Mar. 15, 2004, pp. 175-182, Abstract, Table 1.
Clark: "Some Comments on the Composition and Stability Relations of Mackinawite," 1966.
Craig, Bruce D.: "Effect of Copper on the Protectiveness of Iron Sulfide Films," 1984.
D.O.T. 178.68 Spec. 39, pp. 831-840, Non reusable (non refillable) cylinders, Oct. 1, 2002.
De Medicis, Rinaldo, "Cubic FeS, a Metastable Iron Sulfide", Science, American Association for the Advancement of Science, Steenbock Memorial Library, Dec. 11, 1970, vol. 170, Issue 3963, pp. 723-728.
Echaniz, "The effect of microstructure on the KISSC of low alloy carbon steels", Nace Corrosion '98, EE. UU., Mar. 1998, pp. 22-27, San Diego.
Echaniz, G., Morales, C., Perez, T., "Advances in Corrosion Control and Materials in Oil and Gas Production" Papers from Eurocorr 97 and Eurocorr 98, 13, P. S. Jackman and L.M. Smith, Published for the European Federation of Corrosion, No. 26, European Federation of Corrosion Publications, 1999.
Fang, Hong-Sheng, et al.: "The Developing Prospect of Air-cooled Baintitic Steels", International Journal of Issi, vol. 2, No. 2, Feb. 1, 2005, pp. 9-18.
Gojic, Mirko and Kosec, Ladislav "The Susceptibility to the Hydrogen Embrittlement of Low Alloy Cr and CrMo Steels", ISIJ International, 1997, vol. 37, Issue 4, pp. 412-418.
Heckmann, et al., Development of low carbon Nb—Ti—B microalloyed steels for high strength large diameter linepipe, Ironmaking and Steelmaking, 2005, vol. 32, Issue 4, pp. 337-341.
Howells, et al.: "Challenges for Ultra-Deep Water Riser Systems", IIR, London, Apr. 1997, 11 pages.
Hutchings et al.: "Ratio of Specimen thickness to charging area for reliable hydrogen permeation measurement," 1993.
Iino et al., "Aciers pour pipe-lines resistant au cloquage et au criquage dus a l'hydrogene", Revue de Metallurgie, 1979, vol. 76, Issue 8-9, pp. 591-609.
Ikeda et al., "Influence of Environmental Conditions and Metallurgical Factors on Hydrogen Induced Cracking of Line Pipe Steel", Corrosion/80, National Association of Corrosion Engineers, 1980, vol. 8, pp. 8/1-8/18, Houston, Texas.
Izquierdo, et al.: "Qualification of Weldable X65 Grade Riser Sections with Upset Ends to Improve Fatigue Performance of Deepwater Steel Catenary Risers", Proceedings of the Eighteenth International Offshore and Polar Engineering Conference, Vancouver, BC, Canada, Jul. 6-11, 2008, p. 71.
Jacobs, Lucinda and Emerson, Steven, "Trace Metal Solubility in an Anoxid Fjord", Earth and Planetary Sci. Letters, Elsevier Scientific Publishing Company, 1982, vol. 60, pp. 237-252, Amsterdam, Netherlands.
Johnston, P. W., G.Brooks, "Effect of Al2O3 and TiO2 Additions on the Lubrication Characteristics of Mould Fluxes", Molten Slags, Fluxes and Salts '97 Conference, 1997 pp. 845-850.
Keizer, Joel, "Statistical Thermodynamics of Nonequilibrium Processes", Spinger-Verlag, 1987.
Kishi, T., H.Takeucgi, M.Yamamiya, H.Tsuboi, T.Nakano, T.Ando, "Mold Powder Technology for Continuous Casting of Ti-Stabilized Stainless Steels", Nippon Steel Technical Report, No. 34, Jul. 1987, pp. 11-19.
Korolev, D. F., "The Role of Iron Sulfides in the Accumulation of Molybdenum in Sedimentary Rocks of the Reduced Zone", Geochemistry, 1958, vol. 4, pp. 452-463.
Lee, Sung Man and Lee, Jai Young, "The Effect of the Interface Character of TiC Particles on Hydrogen Trapping in Steel", Acta Metall., 1987, vol. 35, Issue 11, pp. 2695-2700.
Mehling, Wilfred L.: "Hot Upset Forging," ASM Handbook vol. 14, 1998, pp. 84-95.
Mishael, et al., "Practical Applications of Hydrogen Permeation Monitoring," Corrosion, Mar. 28-Apr. 1, 2004.
Morice et al.: "Moessbauer Studies of Iron Sulphides," 1969.
Mukongo, T., P.C.Pistorius, and A.M.Garbers-Craig, "Viscosity Effect of Titanium Pickup by Mould Fluxes for Stainless Steel", Ironmaking and Steelmaking, 2004, vol. 31, No. 2, pp. 135-143.
Mullet et al., "Surface Chemistry and Structural Properties of Mackinawite Prepared by Reaction of Sulfide Ions with Metallic Iron", Geochemica et Cosmochemica Acta, 2002, vol. 66, Issue 5, pp. 829-836.
Murcowchick, James B. and Barnes, H.L., "Formation of a cubic FeS", American Mineralogist, 1986, vol. 71, pp. 1243-1246.
Nagata, M., J. Speer, D. Matlock, "Titanium nitride precipitation behavior in thin slab cast high strength low alloyed steels", Metallurgical and Materials Transactions A, 2002 ,vol. 33A, p. 3099-3110.
Nakai et al., "Development of Steels Resistant to Hydrogen Induced Cracking in Wet Hydrogen Sulfide Environment", Transactions of the ISIJ, 1979, vol. 19, pp. 401-410.
Pressure Equipment Directive 97/23/EC, May 29, 1997, downloaded from website:http://ec.europa.eu/enterprise/pressure_equipment/ped/index_en.html on Aug. 4, 2010.
Prevéy, Paul, et al., "Introduction of Residual Stresses to Enhance Fatigue Performance in the Initial Design", Proceedings of Turbo Expo 2004, Jun. 14-17, 2004, pp. 1-9.
Rickard, D.T., "The Chemistry of Iron Sulphide Formation at Low Tempuratures", Stockholm Contrib. Geol., 1969, vol. 26, pp. 67-95.
Riecke, Ernst and Bohnenkamp, Konrad, "Uber den Einfluss von Gittersoerstellen in Eisen auf die Wassersroffdiffusion", Z. Metallkde.., 1984, vol. 75, pp. 76-81.
Shanabarger, M.R. and Moorhead, R. Dale, "H2O Adsorption onto clean oxygen covered iron films", Surface Science, 1996, vol. 365, pp. 614-624.
Shoesmith, et al., "Formation of Ferrous Monosulfide Polymorphs During Corrosion of Iron by Aqueous Hydrogen Sulfide at 21 degrees C", Journal of the Electrochemical Society, 1980, vol. 127, Issue 5, pp. 1007-1015.
Skoczylas, G., A.Dasgupta, R.Bommaraju, "Characterization of the chemical interactions during casting of High-titanium low carbon enameling steels", 1991 Steelmaking Conference Proceeding, pp. 707-717.

(56) References Cited

OTHER PUBLICATIONS

Smyth, D., et al.: Steel Tublar Products, Properties and Selection: Irons, Steels, and High-Performance Alloys, vol. 1, ASM Handbook, ASM International, 1990, p. 327-336.
Spry, Alan, "Metamorphic Textures", Perganom Press, 1969, New York.
Taira et al., "HIC and SSC Resistance of Line Pipes for Sour Gas Service", Nippon Kokan Technical Report, 1981, vol. 31, Issue 1-13.
Taira et al., "Study on the Evaluation of Environmental Condition of Wet Sour Gas", Corrosion 83 (Reprint. No. 156, National Association of Corrosion Engineers), 1983, pp. 156/2-156/13, Houston, Texas.
Takeno et al., "Metastable Cubic Iron Sulfide—With Special Reference to Mackinawite", American Mineralogist, 1970, vol. 55, pp. 1639-1649.
Tenaris Newsletter for Pipeline Services, Apr. 2005, p. 1-8.
Tenaris Newsletter for Pipeline Services, May 2003, p. 1-8.
Thethi, et al.: "Alternative Construction for High Pressure High Temperature Steel Catenary Risers", OPT USA, Sep. 2003, p. 1-13.
Thewlis, G., Weldability of X100 linepipe, Science and Technology of Welding and Joining, 2000, vol. 5, Issue 6, pp. 365-377.
Tivelli, M., G. Cumino, A. Izquierdo, E. Anelli, A. Di Schino, "Metallurgical Aspects of Heavy Wall—High Strength Seamless Pipes for Deep Water Applications", RioPipeline 2005, Oct. 17 to 19, 2005, Rio (Brasil), Paper No. IBP 1008_05.
Todoroki, T. Ishii, K. Mizuno, A. Hongo, "Effect of crystallization behavior of mold flux on slab surface quality of a Ti-bearing Fe—Cr⇒Ni super alloy cast by means of continuous casting process", Materials Science and Engineering A, 2005, vol. 413-414, p. 121-128.
Turconi, G. L.: "Improvement of resistance to SSC initiation and propagation of high strength OCTG through microstruture and precipitation control"; "Paper 01077", NACE International, Houston, TX, Mar. 16, 2001. (XP009141583).
Vaughan, D. J. And Ridout, M.S., "Moessbauer Studies of Some Sulphide Minerals", J. Inorg Nucl. Chem., 1971, vol. 33, pp. 741-746.
Wegst, C.W., "Stahlüssel", Auflage 1989, Seite 119, 2 pages.
Astm, "E112-13 Standard Test Methods for Determining Average Grain Size," ASTM International. 2012. p. 1-28.
Chitwood, G. B., et al.: "High- Strength Coiled Tubing Expands Service Capabilities", as presented at the 24th Annual OTC in Houston, Texas, May 4-7, 1992, in 15 pages.
Davis, J.R., et al. "ASM—Speciality Handbook—Carbon and alloy steels" ASM Speciality Handbook, Carbon and Alloy Steels, 1996, pp. 12-27, XP002364757 US.
Drill Rod Joint Depth Capacity Chart, downloaded Jan. 15, 2013; http://www.boartlongyear.com/drill-rod-joint-depth-capacity-chart.
E. Anelli, et al., "Metallurgical Design of Advanced Heavy Wall Seamless pipes for Deepwater Applications", 4th International Conference on Pipeline Technology, May 9-13, 2004, Ostend, Belgium.
Extrait du Catalogue N 940, 1994.
Fratini et al.: "Improving friction stir welding of blanks of different thicknesses," Materials Science and Engineering A 459 (2007).
Fritz T et al, "Characterization of electroplated nickel", Microsystem Technologies, Dec. 31, 2002, vol. 9, No. 1-2, pp. 87-91, Berlin, DE.
Gomez, G., et al.: "Air cooled bainitic steels for strong, seamless pipes—Part 1—allowy design, kinetics and microstructure", Materials Science and Technology, vol. 25, No. 12, Dec. 1, 2009. (XP002611498).
Hollomon, J.H., et al., Time-tempered Relations in Tempering Steel. New York Meeting, pp. 223-249, 1945.
ISO. Petroleum and natural gas industries—Materials for use in H2Scontaining environments in oil and gas production. ANSI/NACE ISO, 145 pages, 2009.
Kazutoshi Ohashi et al, "Evaluation of r-value of steels using Vickers hardness test", Journal of Physics: Conference Series, Aug. 7, 2012, p. 12045, vol. 379, No. 1, Institute of Physics Publishing, Bristol, GB.
Tivelli et al., "Metakkurgical Aspects of Heavy Wall—High Strength Seamless Pipes for Deep Water Applications", RioPipeline, Oct. 17-19, 2005, Rio, Brasil.
Mechanical Tubing and Cold Finishing, Metals Handbook Desk Edition, (2000), 5 pages.
NACE MR0175/ISO 15156-1 Petroleum and natural gas industries—Materials for use in H2S-containing Environments in oil and gas production—Part 1: General principles for selection of cracking-resistant materials, Jun. 28, 2007.
Nandan et al.: "Recent advances in friction-stir welding—Process, weldment structure and properties," Progress in Materials Science 53 (2008) 980-1023.
Pollack, Herman, W., Materials Science and Metallurgy, Fourth Edition, pp. 96 and 97, 1988.
Savatori et al.: European Commssion Report, EUR 2006, EUR2207, 3 pp STN_Abstract.
Seamless Steel Tubes for Pressure Purposes-Technical Delivery Conditions—Part 4: Non-alloy and Alloy Steel Tubes with Specified Low Temperature Properties British Standard BS EN 10216-4:2002 + A1:2004 E:1-30, published Mar. 2004.
Specification for Threading, Gauging and Thread Inspection of Casing, Tubing, and Line Pipe Threads, American Petroleum Institute, Specification 5B, Apr. 2008, 15th Edition (Excerpts Only).
Tenaris brochure. Coiled Tubes HS8OCRA, 2 pages, 2008.
Tenaris brochure. Coiled Tubes Suggested Field Welding Procedure (GTAW) for Coiled Tubing Grads HS70, HS80, HS90, HS11 0, 3 pages, 2007.
Tenaris brochure. Coiled Tubing for Downhole Applications, 10 pages, 2007.
"*2019 ASME Boiler and Pressure Vessel Code: An International Code*" New York: American Society of Mechanical Engineers, 2019, pp. 1044-1053.
F. Garofalo. *Fundamentals of Creep and Creep-rupture in Metals.* Macmillan, 1965.. Total Pgs. 8.
D. Jones, et al. *Thor 115 Welding Experience.* Proceedings from the Eight International Conference on Advantages in Materials for Fossil Power Plants, 2016. pp. 1048-1059.
USGS, *Ferroalloys Statistics and Information. 2017 Annual Publication.* Retrieved from https://www.usgs.gov/centers/nmic/ferroalloys-statistics-and-information on Dec. 23, 2020. Total Pgs. 10.

* cited by examiner

HIGH-CHROMIUM HEAT-RESISTANT STEEL

FIELD OF THE INVENTION

The present invention relates to a high-chromium heat-resistant steel.

BACKGROUND OF THE INVENTION

Until now, several 9% Cr heat-resistant steels containing delta ferrite have been proposed as high-chromium steels to improve weldability, and some of them have already been used for steam contacting components in thermal power plants. However, since 9% Cr heat-resistant steels are greatly impaired in long-term creep strength and impact properties, 9% Cr-1% Mo steels having martensitic microstructure not containing delta ferrite are mainly used now. In recent years, temperatures and pressures of steam conditions have been greatly increased to improve thermal efficiency in thermal power plants. Therefore, the operating conditions of power plants are changing from supercritical pressure to ultra supercritical pressure. In addition, plants operable under more severe steam conditions are planned. With such increasing severity in the steam conditions, the presently used 9% Cr-1% Mo steels (Grade 91 steels) cannot be adapted to boiler tubes in future plants because of their limited oxidation resistance and high temperature strength. Meanwhile, austenitic heat resisting stainless steels can be candidate materials to be used for future plants, but the application thereof is limited by economical efficiency. Hence, the development of heat-resistant steels is desired for the usage in steam conditions with even higher temperatures.

Under these circumstances, new types of high chromium steels primarily to improve the creep strength have been developed as disclosed in JP-A-1993-311342, JP-A-1993-311345 and JP-A-1997-291308. These steels have improved creep rupture strength and toughness by the addition of W as a solid-solution hardening element and, further, by the addition of alloy elements such as Co, Ni, and Cu. In addition, JP-A-1988-89644 discloses steels with optimized contents of W and Nb and improved creep strength. U.S. Pat. No. 4,564,392 describes Cr-containing steels in which the ratio of C/N is optimized. The steels exemplified in the latter US patent document contain relatively large amounts of Mo and N. Steel containing 12% Cr is considered particularly suitable for use at high temperatures and under high stress. All of these known steels allegedly have improved creep strength by the addition of alloy elements, such as W and Co to conventional heat-resistant steels through the solid-solution hardening. However, since W and Co are expensive elements leading to increase of material prices, the use of these elements is limited from the viewpoint of economical effects.

Further, the improvement of steam oxidation resistance is indispensable against high temperature steam. In addition, increasing the Cr content from the conventional 9% Cr steels is effective to improve the steam oxidation resistance in the existing condition. However, since increasing the Cr content results in the formation of delta ferrite, the austenite forming elements such as C and Ni are needed to be increased to obtain the tempered martensite structure. However, the contents of these elements are limited because the increase in C and Ni contents reduces the weldability and the long-term creep strength, respectively. Although there are cases where Co or the like is added to suppress the formation of delta ferrite, such an element is expensive, therefore resulting in decrease in the economical efficiency.

DISCLOSURE OF INVENTION

In view of the circumstances described above, an object of the present invention is to provide an improved high-chromium heat-resistant steel, consisting of in mass %, C: 0.08% to 0.13%; Si: 0.15% to 0.45%; Mn: 0.1% to 1.0%; Ni: 0.01% to 0.5%; Cr: 10.0% to 11.5%; Mo: 0.3% to 0.6%; V: 0.10% to 0.25%; Nb: 0.01% to 0.06%; N: 0.015% to 0.07%, B: ≤0.005%, and Al: ≤0.04%, wherein the balance is Fe and inevitable impurity elements. A further object is to provide steel capable of being used for ultra supercritical pressure boilers. A further object is to provide steel improved in creep rupture strength and in steam oxidation properties for high temperature steam under the base of economical steels without addition of expensive elements, such as W and Co.

The steel composition of the present invention comprises low carbon (C), manganese (Mn), silicon (Si), chromium (Cr), nickel (Ni), molybdenum (Mo), vanadium (V), niobium (Nb) and nitrogen (N).

In an embodiment, one or more of the following elements can be added: aluminum (Al) and Boron (B).

The remainder of the composition comprises iron (Fe) and inevitable impurities.

The present invention relates to a high-chromium heat-resistant steel. Embodiments thereof are shown in the following Table 1 (compositions are expressed in mass %), wherein the balance is Fe and inevitable impurity elements:

TABLE 1

| | | Range (mass %) | | Preferred Range | |
|---|---|---|---|---|---|
| Legend | Element | Min | Max | Min | Max |
| M | C | 0.08 | 0.13 | 0.08 | 0.11 |
| M | Si | 0.15 | 0.45 | 0.15 | 0.35 |
| M | Mn | 0.10 | 1.00 | 0.40 | 0.60 |
| M | Ni | 0.01 | 0.50 | 0.01 | 0.20 |
| M | Cr | 10.00 | 11.50 | 10.45 | 11.00 |
| M | Mo | 0.30 | 0.60 | 0.45 | 0.55 |
| M | V | 0.10 | 0.25 | 0.15 | 0.25 |
| M | Nb | 0.010 | 0.060 | 0.035 | 0.060 |
| M | N | 0.0150 | 0.0700 | 0.0400 | 0.0700 |
| O | Al | — | 0.040 | — | 0.025 |
| O | B | 0.001 | 0.005 | 0.002 | 0.004 |
| I | P | — | 0.030 | — | 0.018 |
| I | S | — | 0.010 | — | 0.005 |
| I | Sn | — | 0.0200 | — | 0.0200 |
| I | Pb | — | 0.0030 | — | 0.0030 |
| I | As | — | 0.0120 | — | 0.0120 |
| I | Sb | — | 0.0040 | — | 0.0040 |
| I | Cu | — | 0.25 | — | 0.25 |
| I | Co | — | 0.020 | — | 0.020 |

Legends:
M = Mandatory;
O = Optional;
I = Inevitable impurity element that may be present In an embodiment of the high-chromium heat-resistant steel B is in the range of 0.001% to 0.005% by mass.

In an embodiment of the high-chromium heat-resistant steel, the mass % of the inevitable impurity elements is lower than 0.4%.

In an embodiment of the high-chromium heat-resistant steel, the inevitable impurity elements comprises elements other than: C, Si, Mn, Ni, Cr, Mo, V, Nb, N, Fe.

In an embodiment of the high-chromium heat-resistant steel, the inevitable impurities may comprise one or more of phosphorus (P), sulfur (S), cobalt (Co), copper (Cu), antimony (Sb), arsenic (As), tin (Sn) and lead (Pb).

In an embodiment of the high-chromium heat-resistant steel, P+S+Co+Cu+Sb+As+Sn+Pb≤0.40% (in mass %).

In an embodiment of the high-chromium heat-resistant steel, P+S+Co+Cu+Sb+As+Sn+Pb≤0.35% (in mass %).

The inevitable impurity elements relate to the normal contamination as result of the production of steel.

The present invention has provided a high-chromium heat-resistant steel with improved properties in both the creep rupture strength and steam oxidation resistance, which as hitherto been difficult in the conventional 9Cr-1Mo steel. In addition, the main composition of the present invention does not contain expensive elements such as W and Co and contain a smaller amount of Mo, therefore being advantageous in economical efficiency. Thus, the present invention can meet to the usage for future thermal power plants with higher temperature and pressure as steam conditions.

The invention further relates to a steam contacting component, e.g. a tube, made from a high-chromium heat-resistant steel according to the invention. The tube can be a seamless or welded tube.

The invention further relates to a pressure boiler comprising one or more steam contacting components, e.g. a boiler drum and/or a tube, made from a high-chromium heat-resistant steel according to the invention.

The invention further relates to a thermal power plant comprising a steam contacting component according to the invention.

The invention further relates to a thermal power plant comprising a pressure boiler according to the invention.

DETAILED DESCRIPTION FOR CARRYING OUT THE INVENTION

Reasons for limitations for the individual elements will be discussed below.

C: 0.08% to 0.13%;

C is an austenite forming element suppressing ferrite formation. Hence, an appropriate amount of C is determined with ferrite forming elements such as Cr, in order to obtain the tempered martensite structure. In addition, C precipitates as carbides of the MC type (M represents an alloying element (The same will applies hereinafter.)) and $M_{23}C_6$ type, which greatly affect the high temperature strength, and in particular, creep rupture strength. With C content of less than 0.08%, the amount of precipitation is insufficient for precipitation strengthening, and also the suppression of delta ferrite phase is imperfect. For this reason, the lower limit thereof is set to 0.08%. With the addition of more than 0.13% of C, weldability is impaired and toughness is decreased. Further, agglomerated coarsening of carbides is accelerated resulting in a decrease in the creep rupture strength on the high-temperature and long term side. For this reason, the range thereof is set to 0.08% to 0.13%, preferably within the range of 0.08% to 0.11% (mass percentage)

Si: 0.15% to 0.45%;

Si is added as a deoxidizing agent and for oxidation resistance. However, Si is a strong ferrite forming element and toughness is impaired by the ferrite phase. For this reason, the range thereof is set to 0.15% to 0.45% to balance the oxidation resistance and the tempered martensite structure; preferably within the range of 0.15% to 0.35% (mass percentage)

Mn: 0.1% to 1.0%;

Mn is added as a deoxidizing agent and a desulfurizing agent. In addition, it is also an austenite forming element suppressing the delta ferrite phase, but excessive addition thereof impairs the creep strength. For this reason, the range thereof is set to 0.1% to 1%; preferably within the range of 0.40% to 0.60% (mass percentage)

Ni: 0.01% to 0.5%;

Ni is a strong austenite forming element suppressing ferrite phase formation. However, excessive addition thereof impairs long-term creep rupture strength. For this reason, the range suggested is set from 0.01% to 0.5%, preferably within the range of 0.01% to 0.20% (mass percentage)

Cr: 10.0% to 11.5%;

Cr is an important element for securing steam oxidation resistance. Cr content of 10.0% or more is necessary from the viewpoint of steam oxidation resistance for high temperature steam. However, excessive addition of Cr as well as Si causes ferrite formation and also causes formation of brittle phases in long-term creep, thereby impairing the rupture strength. For this reason, the upper limit thereof is set to 11.5%, preferably within the range of 10.45% to 11% (mass percentage)

Mo: 0.3% to 0.6%;

Mo is a ferrite forming element while it increases the creep strength due to the effect of solid-solution hardening. However, excessive addition thereof results in the formation of delta ferrite and the precipitation of coarse intermetallic compounds not contributing to the creep rupture strength. For this reason, the range thereof is set to 0.3% to 0.6%, preferably within the range of 0.45% to 0.55% (mass percentage)

V: 0.10% to 0.25%;

V precipitates as fine carbonitrides and thereby improves both high temperature strength and creep rupture strength. With a content of less than 0.1%, the amount of precipitation is insufficient to increase the creep strength. In contrast, excessive addition thereof results in formation of bulky V (C, N) precipitates not contributing to the creep strength. For this reason, the range thereof is set to 0.1% to 0.25%, preferably within the range of 0.15% to 0.25% (mass percentage)

Nb: 0.01% to 0.06%;

Nb also precipitates as fine carbonitrides, and is an important element improving the creep rupture strength. A content of 0.01% or more is necessary to obtain this effect. However, similarly as V, excessive addition of Nb results in formation of bulky carbonitrides to reduce the creep rupture strength. Hence, the range thereof is set to 0.01% to 0.06%, preferably within the range of 0.035% to 0.06% (mass percentage)

N: 0.015% to 0.07%,

N precipitates as either nitrides or carbonitrides thereby to improve the creep rupture strength. It is also an austenite forming element to suppress delta ferrite phases. However, excessive addition thereof impairs toughness. For this reason, the range thereof is set to 0.015% to 0.070%, preferably within the range of 0.040% to 0.070% (mass percentage)

Al: ≤0.04%; and

Al can be used as a deoxidizing agent, but it impairs the long-term creep rupture strength with excessive addition. For this reason, when optionally used, the upper limit thereof is set to 0.04%, preferably less than 0.025% (mass percentage)

B: 0.001% to 0.005%.

B is an element strengthening the grain boundary and that has also the effect of the precipitation hardening as $M_{23}(C, B)_6$, thus being effective for improving the creep rupture strength. However, excessive addition thereof impairs workability under high temperatures leading to a cause of cracking, and also impairs the creep rupture ductility. For this reason, when optionally used, the range thereof is set to 0.001% to 0.005%, preferably from 0.002% to 0.004% (mass percentage).

P: ≤0.03%;

P is an Inevitable impurity element contained in melting raw materials and not easily reduced in steel making process. It impairs toughness at room temperatures and high temperatures as well as hot workability. If present, the upper limit is set to 0.03%, preferably lees than 0.018% (mass percentage)

S: ≤0.01%;

S is also an inevitable impurity element and it impairs hot workability. It also can be a cause of cracks, scratches, or the like. If present, the upper limit is set to 0.01%, preferably lees than 0.005% (mass percentage)

In the present invention, the manufacturing conditions are not specifically limited. The tempered martensite structure can be obtained by conventional normalizing treatment heated at temperatures in the range of 950 to 1150 degree centigrade followed by air cooling and tempering treatment heated at temperatures in the range of 700 to 800 degree centigrade.

EXAMPLES

Steels according to the present invention (Nos. A to C) and comparative steels (Nos. D to F) having chemical compositions shown in Table 2 were melted using a vacuum induction melting furnace, cast into 50 kg or 70 kg ingot, and then hot-rolled into steel plates with a thickness of 12 mm to 15 mm. Then, the steel plates were heat treated by normalizing and then tempering. The normalizing temperature is in a range of 1050° C. to 1100° C., and the tempering temperature is in a range of 770° C. to 780° C. Obtained microstructure is a tempered martensite structure, not containing delta ferrite. Among comparative steels, Steel D has a component system of 9Cr-1Mo steels called Grade 91 steels, which are widely used at present. Steel D was used as a steel representing existing materials.

TABLE 2

| Division | Steel | C | Si | Mn | P | S | Ni | Cr | Mo | V | Nb | Al | N | B |
|---|---|---|---|---|---|---|---|---|---|---|---|---|---|---|
| Inventive steel | A | 0.09 | 0.21 | 0.25 | 0.012 | 0.002 | 0.20 | 10.6 | 0.51 | 0.22 | 0.04 | 0.012 | 0.044 | — |
| Inventive steel | B | 0.12 | 0.42 | 0.75 | 0.009 | 0.003 | 0.15 | 10.3 | 0.55 | 0.18 | 0.05 | 0.008 | 0.028 | — |
| Inventive steel | C | 0.11 | 0.18 | 0.48 | 0.013 | 0.001 | 0.41 | 11.3 | 0.34 | 0.20 | 0.03 | 0.015 | 0.040 | 0.0025 |
| Comparative steel Grade91 | D | 0.10 | 0.32 | 0.47 | 0.011 | 0.003 | 0.20 | 8.5 | 0.98 | 0.25 | 0.07 | 0.013 | 0.045 | — |
| Comparative steel | E | 0.13 | 0.29 | 0.53 | 0.015 | 0.004 | 0.17 | 12.2 | 0.48 | 0.21 | 0.03 | 0.007 | 0.048 | — |
| Comparative steel | F | 0.09 | 0.36 | 0.38 | 0.009 | 0.002 | 0.31 | 9.2 | 0.38 | 0.16 | 0.04 | 0.019 | 0.035 | — |

(mass %) The underlined figures indicate the value that is out of the range in the present invention.

Test specimens were taken from the heat treated plates and were subjected to creep rupture testing and steam oxidation testing. Creep rupture testing was performed using a 6 mm diameter specimen under testing temperature of 650° C. and stresses of 110 MPa and 70 MPa. For steels of this type, testing requires tens of thousands hours to clarify superiority or inferiority at testing temperature of 600° C., which is an actual temperature for real thermal power plants. Therefore, the testing temperature was elevated to 650° C., and two stress conditions were applied with estimated rupture time periods of about 1,000 hours and about 10,000 hours. Since the difference in the rupture time among steels is assumed to be small on a short-term side testing of about 1,000 hours using a 110 MPa testing condition, 70 MPa testing condition was applied as long-term testing of about 10,000 hours to differentiate the rupture strength among steels.

For steam oxidation testing, the temperature was set to 650° C., which is the same as that for the creep rupture testing. In the testing, an average thickness of scale formed on the surface of the specimen subjected to 1,000-hour steam oxidation testing was measured using an optical microscope. In this manner, the steam oxidation resistance was evaluated. The specimen is a small sample of 15 mm×20 mm×10 mm taken from the heat treated plate material.

The results of the creep rupture testing and the steam oxidation testing are shown in Table 3.

TABLE 3

| | | Creep rupture time (h) Test temperature 650° C. | | Steam oxidation testing 650° C., |
|---|---|---|---|---|
| Division | Steel | Stress: 110 MPa | Stress: 70 MPa | 1000 h Average scale thickness (μm) |
| Inventive steel | A | 883 | 25,451 | 39 |
| Inventive steel | B | 923 | 23,801 | 40 |
| Inventive steel | C | 783 | 21,985 | 33 |
| Comparative steel | D | 482 | 8,862 | 92 |
| Comparative steel | E | 1,034 | 7,075 | 30 |
| Comparative steel | F | 804 | 21,904 | 72 |

Compared to the steel D equivalent to the existing Grade 91 steel, steels for the present invention demonstrate excellent high temperature properties. For example, the rupture time is three times or more in the long-term testing with the stress of 70 MPa and the average thickness of scale formed in steam oxidation is no more than half. Thus, significant improvements are shown in the creep rupture strength and the steam oxidation resistance.

Comparative steel E having higher Cr content of 12.2% significantly improves the steam oxidation resistance, however it decreases the long-term creep rupture strength. Although the microstructure of Steel E is tempered martensite, not containing delta ferrite, the decreased creep rupture strength is considered owing to an increase in Cr content. Comparative steel F having equivalent Cr content to the existing Grade 91 steels cannot improve the steam oxidation properties with considerably thick scales compared with steels of the present invention.

INDUSTRIAL APPLICABILITY

According to the present invention, it is possible to provide a high-chromium heat-resistant steel that enhances both the creep rupture strength and the steam oxidation resistance even not containing expensive elements such as W and Co and less containing Mo. Therefore the present invention provides excellent economical efficiency. The inventive steel can be advantageously used for steam contacting components, e.g. tubes for a pressure boiler and/or a boiler drum.

The invention claimed is:

1. A high-chromium heat-resistant steel, consisting of, in mass %:

C: 0.08% to 0.13%;
Si: 0.15% to 0.45%;
Mn: 0.1% to 1.0%;
Ni: 0.01% to 0.5%;
Cr: 10.0% to 11.5%;
Mo: 0.3% to 0.6%;
V: 0.15% to 0.25%;
Nb: 0.01% to 0.06%;
N: 0.015% to 0.07%,
B: 0 to 0.005%; and
Al: 0 to 0.04%;
wherein the balance is Fe and inevitable impurity elements.

2. The high-chromium heat-resistant steel of claim 1, wherein B is in the range of 0.001% to 0.005% by mass.

3. The high-chromium heat-resistant steel of claim 1, wherein the mass % of the inevitable impurity elements is lower than 0.4%.

4. The high-chromium heat resistant steel of claim 1, consisting of, in mass %:

C: 0.08% to 0.11%;
Si: 0.15% to 0.35%;
Mn: 0.40% to 0.60%;
Ni: 0.01% to 0.2%;
Cr: 10.45% to 11.0%;
Mo: 0.45% to 0.55%;
V: 0.15% to 0.25%;
Nb: 0.035% to 0.06%;
N: 0.040% to 0.070%;
B: 0 to 0.005%; and
Al: 0 to 0.04%;
wherein the balance is Fe and inevitable impurity elements.

5. The high-chromium heat-resistant steel of claim 4, wherein B is in the range of 0.002% to 0.004%.

6. The high-chromium heat-resistant steel of claim 4, wherein Al: 0 to 0.025% by mass.

7. A steam contacting component made from the high-chromium heat-resistant steel of claim 1.

8. A pressure boiler comprising one or more steam contacting components made from the high-chromium heat-resistant steel of claim 1.

9. A thermal power plant comprising the steam contacting component of claim 7.

10. A thermal power plant comprising the pressure boiler of claim 8.

11. The steam contacting component of claim 7, wherein the steam contacting component is a tube.

12. The pressure boiler of claim 8, wherein the one or more steam contacting components is a boiler drum.

13. The pressure boiler of claim 8, wherein the one or more steam contacting components is a tube.

14. The high-chromium heat-resistant steel of claim 1, wherein the steel has a martensitic microstructure.

15. The high-chromium heat-resistant steel of claim 14, wherein the steel does not contain delta ferrite.

16. The high-chromium heat-resistant steel of claim 1, wherein the steel has a creep rupture time of at least 21,985 hours under a temperature of 650° C. and a stress of 70 MPa.

17. The high-chromium heat-resistant steel of claim 1, wherein the steel has a creep rupture time of at least 23,801 hours under a stress of 70 MPa at a temperature of 650° C.

18. The high-chromium heat-resistant steel of claim 1, wherein the steel has a creep rupture time of at least 25,451 hours under a stress of 70 MPa at a temperature of 650° C.

19. The high-chromium heat-resistant steel of claim 1, wherein the steel has a creep rupture time of between 21,985 and 25,451 hours under a stress of 70 MPa at a temperature of 650° C.

20. The high-chromium heat-resistant steel of claim 1, wherein the steel forms an average scale thickness of at most 33 μm under a steam oxidation temperature of 650° C. for 1000 hours.

21. The high-chromium heat-resistant steel of claim 1, wherein the steel forms an average scale thickness of at most 39 μm of under a steam oxidation temperature of 650° C. for 1000 hours.

22. The high-chromium heat-resistant steel of claim 1, wherein the steel forms an average scale thickness of at most 40 μm under a steam oxidation temperature of 650° C. for 1000 hours.

23. The high-chromium heat-resistant steel of claim 1, wherein the steel forms an average scale thickness of 33 to 40 μm under a steam oxidation temperature of 650° C. for 1000 hours.

24. The high-chromium heat-resistant steel of claim 1, wherein the steel has a creep rupture time of between 21,985 and 25,451 hours under a stress of 70 MPa at a temperature of 650° C., and wherein the steel forms an average scale thickness of 33 to 40 μm under a steam oxidation temperature of 650° C. for 1000 hours.

25. The high-chromium heat-resistant steel of claim 1, wherein Ni is in the range of 0.01% to 0.2% by mass.

26. The high-chromium heat-resistant steel of claim 1, wherein Mo is in the range of 0.45% to 0.6% by mass.

* * * * *